US005323838A

United States Patent [19]

Hamashima et al.

[11] Patent Number: 5,323,838

[45] Date of Patent: Jun. 28, 1994

[54] INJECTION SLEEVE FOR DIE CASTING AND A METHOD OF CASTING AN ALUMINUM OR AN ALUMINUM ALLOY PART

[75] Inventors: Kazuo Hamashima, Yokohama; Kimihiko Sato, Takasago, both of Japan

[73] Assignee: Asahi Glass Company Ltd., Tokyo, Japan

[21] Appl. No.: 88,741

[22] Filed: Jul. 8, 1993

[30] Foreign Application Priority Data

Jul. 8, 1992 [JP] Japan ..... 4-204474

[51] Int. Cl.[5] ..... B22D 17/10; B22D 17/20

[52] U.S. Cl. ..... 164/113; 164/312

[58] Field of Search ..... 164/113, 138, 312, 306, 164/309, 316

[56] References Cited

U.S. PATENT DOCUMENTS

| | | | |
|---|---|---|---|
| 3,664,411 | 5/1972 | Carver et al. | 164/312 |
| 4,556,098 | 12/1985 | Hintermann et al. | 164/138 X |
| 4,733,715 | 3/1988 | Matsuzaki et al. | 164/312 X |
| 5,022,919 | 6/1991 | Shinozaki et al. . | |

FOREIGN PATENT DOCUMENTS

| | | | |
|---|---|---|---|
| 60-2949 | 1/1985 | Japan . | |
| 62-196353 | 8/1987 | Japan . | |
| 62-289358 | 12/1987 | Japan | 164/312 |
| 63-72464 | 4/1988 | Japan . | |
| 63-143236 | 6/1988 | Japan . | |
| 1-104453 | 4/1989 | Japan | 164/312 |
| 1-131070 | 5/1989 | Japan . | |
| 1-317690 | 12/1989 | Japan | 164/312 |
| 2-160156 | 6/1990 | Japan | 164/312 |
| 2-299740 | 12/1990 | Japan . | |

OTHER PUBLICATIONS

Reports Research Laboratory Asahi Glass Co., Ltd., 40(2), 1990, pp. 243-251, Kazuo Hamashima, et al., "Mechanical Properties of Boride Cermet at High Temperature".

Soviet Power Metallurgy and Metal Ceramics, No. 8 (44), pp. 665-670, P. T. Kolomytsev, et al., "Phase Composition and Some Properties of Alloys of the System Molybdenum-Nickel-Boron" Aug. 1966.

*Primary Examiner*—J. Reed Batten, Jr.

*Attorney, Agent, or Firm*—Oblon, Spivak, McClelland, Maier & Neustadt

[57] ABSTRACT

The injection sleeve comprises: a cylindrical cermet sintered body comprising a hard ceramic phase whose major components are at least one selected from the group consisting of a complex boride of Ni and Mo, a complex boride of Ni and W and a complex boride of Ni, Mo and W and a metal matrix phase consisting of a solid solution whose major components are Ni and Mo. The cylindrical cermet sintered body contains the hard ceramic phase in an amount of not less than 50% by weight and not more than 90% by weight.

7 Claims, 3 Drawing Sheets

INJECTION SLEEVE FOR DIE CASTING AND A METHOD OF CASTING AN ALUMINUM OR AN ALUMINUM ALLOY PART

BACKGROUND OF THE INVENTION

1. Field of the Invention

This invention relates to an injection sleeve for die casting which is employed for die-casting a molten metal such as aluminum (Al), an aluminum alloy and zinc (Zn).

2. Background of the Invention

The die casting method wherein a molten metal such as aluminum, an aluminum alloy or zinc is supplied to an injection sleeve of a die casting machine, the molten metal is injected into a die casting mold by a plunger tip at a high speed, a high pressure is applied on the molten metal and the molten metal is solidified in the mold, is widely employed in the production of metal parts in the industrial fields making automobiles, electric machines and the like. The reason is that the time required for casting a single piece of product is significantly short and the production cost is inexpensive compared with the other casting methods.

In the die casting method, the casting cycle wherein the molten metal is transmitted into the inner portion of the mold of the casting machine at a high flow rate and is solidified, is finished in a very short time period compared with those of the other casting methods. This casting cycle is repeated at a high frequency. Therefore, a portion contacting the molten metal, especially the injection sleeve or the die casting mold requires a material provided with an excellent corrosion resistance and erosion resistance against the molten metal and the thermal shock resistance against the repetitively performed heating and cooling cycle.

In casting aluminum or an aluminum alloy having a comparatively high casting temperature, these parts are required to stand an extremely severe condition. Conventionally, a material has been utilized for these parts, wherein an alloy steel, such as SKD 61, is heat-treated and further treated with a nitriding-treatment on its surface.

Further, there is a considerable difference between conditions of contacting the molten metal between the injection sleeve and the die casting mold. When the temperature of the molten metal which is transmitted into the sleeve is lowered, the viscosity of the molten metal increases and further a portion thereof is precipitated, the structure of the cast product becomes inhomogeneous which adversely influences the product property. Therefore, the cooling of the molten metal should be avoided as much as possible at the injection sleeve. On the other hand, the mold is sufficiently cooled down since the inner portion thereof is a portion for solidifying the molten metal.

The corrosion is significant on the inner face of the injection sleeve, especially in the region beneath a feeding port, since this region contacts the molten metal having a relatively high temperature. The service life of the injection sleeve made of an alloy steel is short even if the nitrization-treatment is performed thereon. However, no promising material has been found as the material for the conventional injection sleeve other than the alloy steel. The injection sleeve of an alloy steel, such as SKD 61, is currently employed while cooling the portion thereof wherein the corrosion is significantly caused, in a range allowable for the injection sleeve.

Further, a plunger tip (a piston-like member padded with Colmoloy alloy on its surface and the inside thereof is water-cooled) should rapidly be moved in the injection sleeve and the molten metal should be pressurized in the mold in a short period of time. Therefore, a sufficient lubricity should be maintained between the inner face of the injection sleeve and the plunger tip. In this view, the injection sleeve made of an alloy steel is problematic, and a lubricant wherein carbon is mixed with water should be supplied by about several tens ml per a casting. This lubricant is thermally decomposed into gases by the heat of the molten metal. These gases are incorporated in the inner portion of the molten metal which causes pores remained in the cast product.

In recent times, trials have been performed wherein ceramics having an essentially high corrosion resistance against the molten metal and the thermal shock resistance due to its small thermal expansion, for instance, sialon in Japanese Unexamined Patent Publication No. 72464/1988, or silicon nitride in Japanese Examined Patent Publication No. 2949/1985, is employed in the injection sleeve for die casting.

However, the toughness and the thermal shock resistance of these ceramic sleeves are not sufficiently high. Even when these sleeves are reinforced by fitting the ceramic sleeve into a metal cylinder, almost no reinforcement effect can be provided in the temperature range of usage, since the thermal expansion (3 to $4\times10^{-6}/°$ C.) is significantly smaller than the thermal expansion of the metal cylinder (in case of SKD 61, 13 to $14\times10^{-6}/°$ C.). Therefore, the condition of usage is limited and the sleeve is destructed by mechanical impact or by thermal shock in its usage, which does not reach the stage of practical use.

A cermet sintered body was proposed in Soviet Powder metallurgy and Metal Ceramics No. 8(44) p665–670, 1966 and in Japanese Unexamined Patent Publication No. 196353/1987, which was provided with a hard ceramic phase of a Mo-Ni complex boride and a metal matrix phase of an Ni base alloy. Further, the chemical corrosion resistance and the oxidation resistance of a cermet sintered body can be promoted by further adding chromium to the cermet sintered body.

The present inventors proposed a cermet sintered body composed of a hard ceramic phase whose major component is a Ni-Mo complex boride, a Ni-W complex boride or a Ni-Mo-W complex boride and a metal matrix phase whose major component was an Ni-Mo alloy, in Japanese unexamined Patent Publication No. 143236/1988, and showed that the cermet sintered body was a material having a large strength and hardness at an elevated temperature, compared with those in a WC-Co cemented carbide and the like. In Japanese Unexamined Patent Publications No. 143236/1988, the inventors proposed a material wherein a carbide was added to the cermet sintered body of this species to promote the strength and the hardness at an elevated temperature.

Further, the inventors proposed a mold (cooled) for die-casting the molten metal such as aluminum or zinc, as a specific use of these cermet sintered body in Japanese Unexamined Patent Publication No. 299740/1990.

However, concerning the problem whether the cermet sintered body of this system can be used as the injection sleeve for aluminum which is employed under a severer condition, the adaptability thereof has been unclarified in case wherein the cooling is not performed, since the cermet sintered body incorporates the metal matrix phase whose major component is nickel and the metal matrix phase is comparatively weak at corrosion by the molten aluminum and the like, and, therefore, the adaptability of the cermet sintered body without cooling has been doubtful.

SUMMARY OF THE INVENTION

It is an object of this invention to provide an injection sleeve for die casting which is excellent in the service life by finding a material capable of solving the above problems.

According to an aspect of the present invention, there is provided an injection sleeve for die casting comprising:

a cylindrical cermet sintered body comprising a hard ceramic phase whose major components are at least one selected from the group consisting of a complex boride of Ni and Mo, a complex boride of Ni and W and a complex boride of Ni, Mo and W and a metal matrix phase consisted of an alloy whose major components are Ni and Mo, said cylindrical cermet sintered body containing the hard ceramic phase of not less than 50% by weight and not more than 90% by weight.

DETAILED DESCRIPTION OF THE PREFERRED EMBODIMENTS

Figure 1:
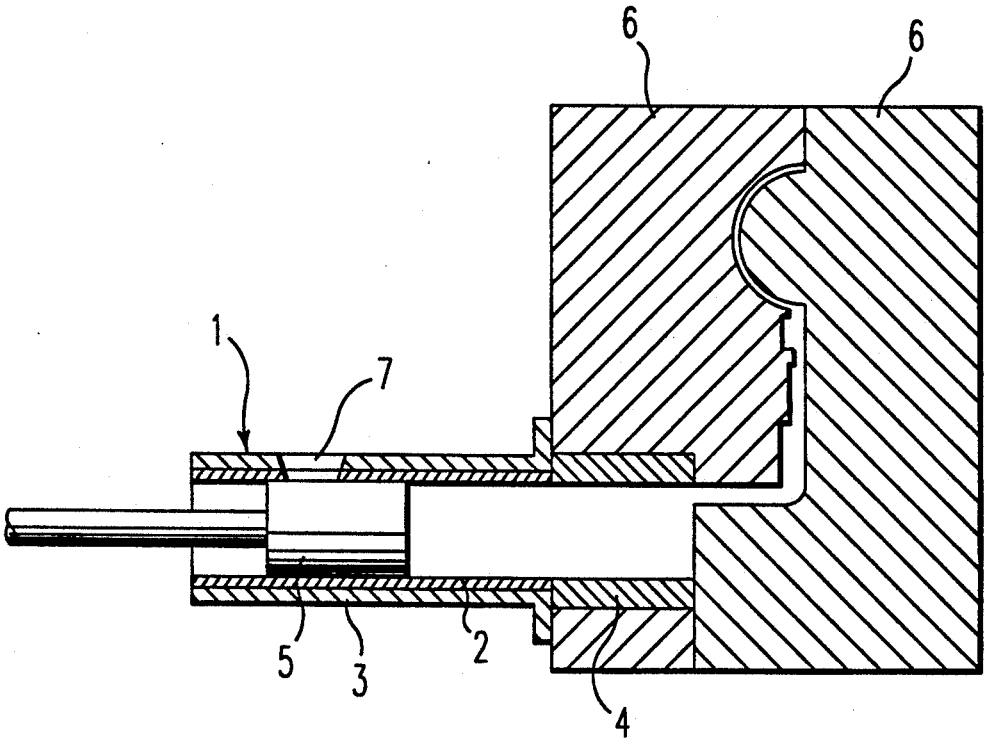
FIG. 1 is a sectional diagram showing an example of a situation wherein an injection sleeve for die casting according to this invention is attached to a die casting machine.

As is stated in the above-mentioned Japanese Unexamined Patent Publication No. 143236/1988 or Japanese Unexamined Patent Publication No. 28840/1992, in making the invented injection sleeve, powders of Mo, W, Ni, MoB, WB, Ni B alloy, a complex boride of Ni and Mo, a complex boride of Ni and W, Ta, Nb, Cr, Co, $TaB_2$, $NbB_2$, WC, TiC or the like is selected as a starting raw material, which is mixed, milled, formed, and sintered into a cermet sintered body, which is formed into a required dimension and construction by grinding and working by a diamond grinding wheel, an electric discharge machining, a press-fitting into a metal cylinder, or the like.

Among the component of the cermet sintered body, Ta and Nb have an effect of enhancing the strength, the toughness and the corrosion resistance of the cermet sintered body, Co, an effect of enhancing the toughness and the strength at an elevated temperature of the cermet sintered body, a carbide such as WC or TiC, an effect of enhancing the strength and the hardness of the cermet sintered body, and Cr, an effect of enhancing the oxidation resistance of the cermet sintered body. The preferable contents of these components added to the raw material are 8 to 15 wt % for Cr and Co, 2 to 8 wt % for Ta, 1 to 5 wt % for Nb and 0.5 to 15 wt % for the carbide. When the addition contents of these components are small, almost no effect in promoting the material property of cermet sintered body can be obtained, whereas when these components are added thereto in excessive amounts, the toughness of the cermet sintered body is apt to decrease owing to the generation of an unpreferable phase and the like.

In the structure of the cermet sintered body of this species, the particles of the hard ceramic phase are surrounded by the metal matrix phase, the section of the hard ceramic phase composed of complex borides is in a polygonal form, the mean particle diameter of the ceramic crystal grains is for instance, approximately 5 μm, and the thickness of the metal matrix phase separating the hard ceramic phases is normally not more than 5 μm.

In the injection sleeve for die-casting of this invention, the service life of the injection sleeve is significantly prolonged without performing the cooling, compared with the case wherein the conventional injection sleeve of an alloy steel is employed, by using a cermet sintered body of a specified material. Further, a preferable effect which has not been predicted is provided, by employing the injection sleeve for die casting of this invention, the service life of the injection sleeve is excellent, and as mentioned later, the quality of the die-cast product is significantly improved.

The hard ceramic phase of the complex boride is provided with an excellent corrosion resistance against the molten metal such as aluminum, compared with the metal matrix phase, whereas the metal matrix phase is provided with less corrosion resistance against the molten metal. The reason that the content of the complex boride incorporated in the cermet sintered body is determined to be not less than 50 wt %, is to provide the cermet sintered body with an excellent corrosion resistance compared with an alloy steel such as SKD 61 (JIS standard), and the service life of the injection sleeve can significantly be prolonged. However, when the content of the hard ceramic phase comprising the complex boride of the cermet sintered body exceeds 90 wt %, the cermet sintered body becomes brittle and cracks are apt to cause at the injection sleeve by the thermal shock in casting aluminum and the like.

The content of the hard ceramic phase in the cermet sintered body is preferably not less than 65 wt % and not more than 80 wt %, more preferably not less than 70 wt % and not more than 80 wt %, in consideration of the corrosion resistance and the strength at an elevated temperature of the cermet sintered body controlling the service life of the injection sleeve.

The metal matrix phase is of a Ni alloy wherein Mo and the like are dissolved in Ni. The hard ceramic phase of the complex boride dissolves into the Ni alloy to some degree in an elevated temperature range wherein the sintering is performed. Therefore, the wettability between the hard ceramic phase composed of the complex boride and the metal matrix phase is good, and an interface strength between the hard ceramic phase and the metal matrix phase is large when the cermet sintered body is formed.

When Mo is dissolved in an Ni alloy, the corrosion resistance against the molten metal of the cermet sintered body is improved. However, when the content of Mo is too much, Mo which is not dissolved in the Ni alloy, is precipitated as an inter-metallic compound, which may deteriorate the material property. Accordingly, the dissolved content of Mo in a Ni alloy is preferably not less than 10 wt % and not more than 30 wt %, more preferably, not less than 15 wt % and not more than 25 wt %. When the dissolved content of Mo is in this range, the excellent strength, the hardness and the corrosion resistance against the molten metal of the cermet sintered body are provided and the inter-metallic compound is not formed in sintering which causes to deteriorate the material property by an interactive reaction between superfluous metals.

The wt % of the hard ceramic phase of the cermet sintered body can be provided by an approximate estimation assuming that all the boron component is incorporated into the complex boride. Other than that, the vol % can be calculated by observing the section of the cermet sintered body by a scanning electron microscope (SEM) from the ratio of the integrated section area of the hard ceramic phase on the surface. Although the specific weights of the hard ceramic phase and the metallic matrix phase vary to some degree with the chemical compositions, approximately the vol % is equal to wt %.

Further, when the injection sleeve composed of the cermet sintered body is employed in die casting the molten metal, the metal matrix phase on the surface of the cermet sintered body is worn by aluminum oxide or carbon particles which has been derived from a lubricant supplied to the injection sleeve in the initial stage of each run. Moreover, the metal matrix phase is selectively corroded by the molten metal such as aluminum and is corroded up to the depth of approximately 1 $\mu$m. However, the depth of corrosion is small compared with the sizes of the hard ceramic phase crystal particles. Therefore, the crystal particles of the hard ceramic phase do not drop off from the surface of the cermet sintered body.

Thereafter, even when the casting of the molten metal is repeated, the corrosion of the metallic matrix phase at a portion apart from the surface is significantly retarded since the molten metal is provided with considerable viscosity and hard to wet the hard ceramic phase on the surface. Therefore, an excellent durability is shown even when the cooling is not performed on the injection sleeve.

The metal matrix phase of the injection sleeve is not subjected directly to the abrasion by the plunger tip in its usage due to the above reason. The friction stress of the injection sleeve is considerably decreased. This is attributed to the fact that the hard ceramic phase of the cermet sintered body is of the complex boride.

When the die casting of aluminum or an aluminum alloy is performed by employing the conventional injection sleeve of an alloy steel, since the thermal conductivity of the alloy steel is considerably large and the cooling is partially performed, the temperature of the molten metal is lowered at a face thereof contacting the injection sleeve, a portion thereof is solidified, a so-called chilled layer is caused in the structure of the cast product, which causes the lowering of the mechanical property of the cast product.

Further, when the temperature of the molten metal is lowered, the viscosity of the molten metal necessarily increases, and the flow rate of the molten metal injected into the mold decreases. As a result, the packing density of the molten metal at the corners of the die casting mold decreases, the time required for injection is prolonged, the cooling speed of the molten metal in casting is retarded, the metal structure of the cast product becomes coarse, a dendric crystal structure is caused and the material property of the cast product is not as good as expected.

When the injection sleeve of the present invention is employed, the following significant improvement effects are provided with respect to these problems. That is to say, the complex boride composing the hard ceramic phase of this cermet sintered body is hard to wet with respect to the molten metal. The molten metal does not contact the metal matrix phase at a position apart form the surface in a state wherein the pressure is not applied on the molten metal. When the pressure is not applied on the molten metal, the molten metal does not contact the injection sleeve at its total face and the heat conduction area is small. Therefore, an effect is provided wherein the cooling speed of the molten metal introduced in the inner portion of the injection sleeve is retarded.

Further, the thermal conductivity (unit: cal/cm.sec.° C.) of an alloy steel (SKD 61) is 0.073 at 20 ° C., and 0.068 at 600° C., whereas that of an example of a cermet sintered body employed in the invented injection sleeve is respectively 0.032 at 20° and 0.050 at 600° C. Therefore, the cooling speed of the molten metal is further retarded.

In this way, the molten metal having a high temperature and a low viscosity is injected into the die casting mold at a high speed, the pressure of the plunger tip reaches the corners of the mold thereby filling the molten metal without gaps and the solidification is finished in a short period of time. Other than that, the application of a lubricant can be minimized. As the results, the crystal structure of the cast product becomes fine and dense. Many problems in using the conventional injection sleeve such as the incorporation of the chilled layer or pores are simultaneously solved, thereby significantly improving the property of the cast product.

It is not necessary to make the injection sleeve wholly with the cermet sintered body. When a metal cylinder is fit to the outer periphery of the cylindrical cermet sintered body by shrinkage fit or the like, the injection sleeve can be manufactured at a low cost. The practical usage strength of the sleeve can be enhanced by applying a compressive stress from the outer periphery by the shrinkage fit. In this case, the thermal expansion of the cermet sintered body (8.5 to $9\times10-6/°$ C.) is not so much different from the thermal expansion of the metal cylinder as in the aforementioned ceramics. Therefore, the reinforcement effect by the shrinkage fit is sufficiently effective in the operating temperature of the sleeve.

Further, it is possible to promote further the service life of the injection sleeve by increasing the content of the hard ceramic phase at a portion which first contacts the molten metal when the high temperature molten metal is fed into the injection sleeve, since the hard ceramic phase of the complex boride has high corrosion resistance against the molten metal.

As a method of making such an injection sleeve, for instance, in case of forming a cylinder by isostatic pressing, raw material powders having much content of the hard ceramic phase are coated on the desired surface of a metal core mold, and normal raw material powders are filled in a surrounding rubber mold, thereby providing a formed body integrated with a coating layer which is replete with the hard ceramic phase on the inner face side of the cylinder. Further, a injection sleeve wherein the content of the hard ceramic phase is gradually changed can be provided when a plurality of coating operations are performed on the surface of the metal core mold.

A corner tipping is apt to cause at an end of the injection sleeve of the cylindrical cermet sintered body contacting the die casting mold, since it is necessary to fix the injection sleeve by firmly pushing the injection sleeve on the die casting mold. However, the problem of the corner tipping can be avoided by enhancing the toughness by increasing the content of the metal matrix phase at this portion, since the corrosion is mild at this portion because the heat is transferred to the contacting injection mold. (The cooling thereof is performed.)

An injection sleeve having such a construction can be manufactured by the aforementioned isostatic press or may be bound with a ring-like cermet sintered body which is separately manufactured, by diffusion bonding. Further, as another convenient method, a ring of an alloy steel may be installed at this portion.

As another preferable injection sleeve for die casting of this invention, a tapered portion is provided on the outer periphery of the cylindrical cermet sintered body of the injection sleeve in the vicinity of an end portion contacting the die casting mold, which fits to a tapered portion provided on an inner periphery of a corresponding end portion of a fitted metal cylinder, and the other end portion of the cylindrical cermet sintered body is fixed such that the cylindrical cermet sintered body does not come off, by a metal ring which is installed to the other end portion of the metal cylinder.

All the inner face of the injection sleeve up to the portion contacting the die casting mold can be constructed by the cermet sintered body, since the portion of the cylindrical cermet sintered body in the vicinity contacting the die casting mold has the tapered portion. Thereby, the excellent service life of the injection sleeve can be provided. Further, when the shrinkage fit is performed by a metal cylinder having a larger thermal expansion and smaller Young's modulus than those of the cermet sintered body, the cylindrical cermet sintered body may partially be protruded by the residual stress accompanied by the shrinkage fit.

Therefore, there may be a case wherein the cylindrical cermet sintered body comes off the injection sleeve and the edge of the cylindrical cermet sintered body is tipped off. However, the injection sleeve is provided with the metal ring on the side of the plunger tip which is fixed by screwing or by welding. Therefore, the cylindrical cermet sintered body does not come off the metal cylinder and the danger of edge tipping is avoided. Further, when a compressive stress is applied in the longitudinal direction of the cylindrical cermet sintered body having smaller toughness than that of a metal cylinder, the cylindrical cermet sintered body is further reinforced.

An especially preferable effect can be provided in case of casting aluminum or an aluminum alloy in the die casting machine integrated with the invented injection sleeve. That is to say, when aluminum or an aluminum alloy is cast, the region under a feeding port of the injection sleeve which first contacts the molten metal, receives a considerable corrosion action and thermal shock by the molten metal, since the temperature of the molten metal which is fed to the injection sleeve is as high a 650° C. through 720° C.

However, the invented injection sleeve can stands this severe condition without performing the partial cooling, and has an excellent service life. The quality of the cast metal part is significantly promoted, since the temperature of the molten metal injected into the die casting mold can be maintained at a pertinent value and the molten metal is transmitted at a high speed to every corner of the mold and is solidified in a short period of time.

EXAMPLE

An explanation will be given of a specific Example of an injection sleeve according to this invention as follows. However, this invention is not restricted by the following Examples.

TEST EXAMPLE 1

MoB raw material powder was weighed by a rate of 53 wt %, WB, 7 wt %, Ni, 33 wt % and Mo, 7 wt %. These powders were added with ethyl alcohol as a dispersion media, mixed and ground in a pot mill, and dried under reduced pressure, which are formed into a cylinder by an isostatic press. The formed body was sintered at 1300° C. and ground into a cylindrical cermet sintered body having an inner diameter of 60 mm, an outer diameter of 70 mm and a length of 250 mm. The content of the hard ceramic phase of a cermet sintered body measured with a probe which was made of the same raw mixed powder simultaneously with the cermet sintered body, was 72 wt %, the bending strength thereof, 210 $kg/mm^2$ and the fracture toughness thereof, 17 $MN/m^{3/2}$.

A cylinder of an alloy steel was shrink-fitted on the outer periphery of the cylindrical cermet sintered body, thereby providing an injection sleeve. Further, a feeding port having an inner diameter of approximately 50 mm is provided on the peripheral face of the injection sleeve. As shown in the sectional diagram of FIG. 1, the injection sleeve is integrated to a 250 ton type die casting machine, and the die casting of an aluminum alloy (ADC 12) is performed at a casting interval of 28 sec. The cast product was a plate with grooves having dimensions of 3 mm×30 mm×60 mm.

In this test, the temperature of the fed molten aluminum alloy was 680° C., the quantity of the supplied molten metal was approximately 700 g/time, the injection rate was 2.5 m/min, the supply quantity of a lubricant (water containing carbon) was a few ml/time, and the partial water-cooling at the region beneath the feeding port which was performed in the conventional injection sleeve, was not carried out. The service life of the injection sleeve marked a record of approximately 330,000 times. The service life was determined when the inner side of the sleeve beneath the feeding port was recessed by corrosion and the movement of the plunger tip was not performed smoothly.

In FIG. 1, a reference numeral 1 designates an injection sleeve, 2, a cylindrical cermet sintered body, 3, a metal cylinder, 4, a die sleeve of an alloy steel, 5, a plunger tip, 6, a die casting mold and 7, a feeding port.

TEST EXAMPLE 2

The die casting was performed employing an injection sleeve made of a conventional alloy steel (SKD 61) with a nitriding-treatment under the condition similar to that in Test Example 1. However, the casting was carried out while performing the partial water-cooling beneath the feeding port.

Figure 2:
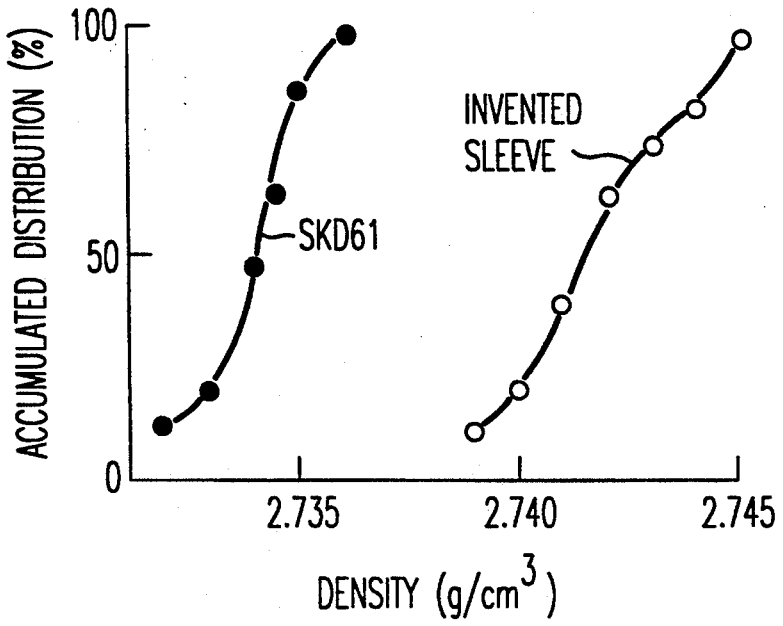
FIG. 2 shows graphs of an accumulated distribution of a density of a cast product which is obtained by employing an invented injection sleeve for die casting and a conventional injection sleeve for die casting.
Figure 3:
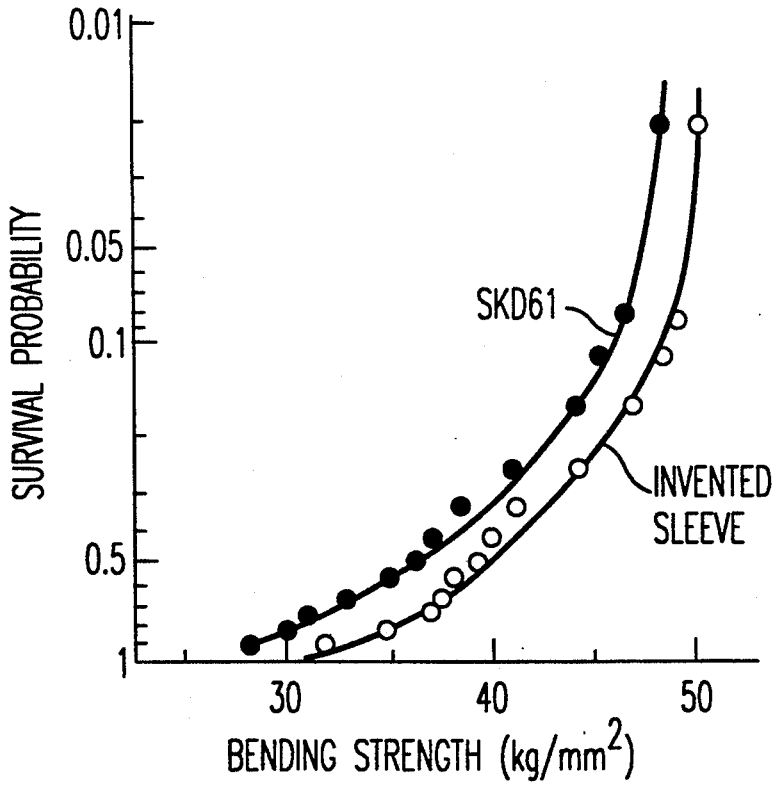
FIG. 3 shows graphs of a survival probability with respect to a bending strength of a cast product which is obtained by employing an invented injection sleeve for die casting and a conventional injection sleeve for die casting.

The densities of approximately 100 pieces of plates with grooves having dimensions of 3 mm×30 mm×60 mm which were die-casted in Test Examples 1 and 2, the bending strengths of test pieces cut out from the plates with grooves (it was assumed that the cast product was not deformed elastically) were measured, the accumulated distribution of the densities of the cast plates and the rate (survival probability) of the test pieces which remained unbroken when bending stresses were applied, were compared, and the results are respectively shown in graphs of FIGS. 2 and 3. These graphs reveal that the properties of the cast product (density and bending strength) were significantly improved by employing the invented injection sleeve. Further, the injection sleeve of Test Example 2 (conventional) became unusable by being corroded at the inner side of the injection sleeve and its service life was approximately 120,000 times.

TEST EXAMPLES 3 to 10

As in Test Example 1, injection sleeves composed of cylindrical cermet sintered bodies having compositions shown in Table 1 and fitted metal cylinders were formed and the casting test was performed. The content of the hard ceramic phase, the bending strengths, the fracture toughnesses and the service lives of the injection sleeves utilizing cermet sintered bodies are also shown in Table 1.

According to the injection sleeve of this invention, the effect of reinforcement of the cermet sintered body by the shrinkage-fitting is excellent, the corrosion resistance against the molten metal and the strength at an elevated temperature of the cermet sintered body are excellent, and, therefore, the service life of the injection sleeve can considerably be prolonged without cooling the region beneath the feeding port. Further, the applied quantity of the lubricant which is the cause for introducing pores in the cast product, can considerably be reduced, since the friction stress between the injection sleeve and the plunger tip is small.

Further, the heat dissipation rate through the cermet sintered body constituting the injection sleeve is smaller than that of the conventional alloy steel, and the cooling of the injection sleeve can be dispensed with. Therefore, the temperature of the molten metal can be maintained at a pertinent value, the molten metal can be transmitted to every corner of the die casting mold in a short period of time while maintaining the pertinent temperature, and the cooling and solidification are finished in a short period of time. Therefore, the properties of the die-cast product can significantly be improved by these synthesizing effects.

Accordingly, when the invented injection sleeve is employed, the operating efficiency of a die casting machine can be promoted since the service life of the injection sleeve is prolonged. The yield rate of the product is promoted since the defects of the cast product are reduced, and the quality of the product is significantly improved. Meanwhile, the die casting is prevailing in manufacturing metal parts. Therefore, its value in industrial utilization is great.

TABLE 1

| Test Example | Raw material composition of cermet sintered body (wt %) MoB | WB | Ni | Mo | $TaB_2$ | WC | Co | $NbB_2$ | Hard ceramic phase (wt %) | Service life ($\times 10^4$ times) | Bending stress ($kg/mm^2$) | Fracture toughness ($MN/m^{3/2}$) |
|---|---|---|---|---|---|---|---|---|---|---|---|---|
| 3 | 45 | 8 | 38 | 9 | — | — | — | — | 65 | 28 | 230 | 20 |
| 4 | 40 | — | 48 | 9 | 3 | — | — | — | 54 | 18 | 240 | 26 |
| 5 | 65 | 8 | 25 | 2 | — | — | — | — | 88 | 22 | 180 | 14 |
| 6 | — | 55 | 35 | 3 | — | 7 | — | — | 67 | 25 | 200 | 18 |
| 7 | 66 | 9 | 23 | 2 | — | — | — | — | 92 | 9 | 155 | 12 |
| 8 | 32 | 5 | 48 | 15 | — | — | — | — | 45 | 14 | 200 | 28 |
| 9 | 47 | 9 | 32 | 6 | — | — | 6 | — | 71 | 37 | 210 | 20 |
| 10 | 50 | — | 35 | 12 | — | — | — | 3 | 73 | 30 | 210 | 17 |

TEST EXAMPLE 11

The casting test was performed employing the injection sleeve of the aforementioned conventional alloy steel and without performing the partial cooling at the portion which first contacted the molten steel. The corrosion beneath the feeding port was considerable and the service life was as short as approximately 4,200 times.

The cause whereby the injection sleeve could not be employed further, was the corrosion beneath the feeding port in Test Examples 3, 4, 6, 8, 9, 10 and 11, and the cracks generated at the cylindrical cermet sintered body when the casting was temporarily interrupted and restarted, in Test Examples 5 and 7.

Figure 4:
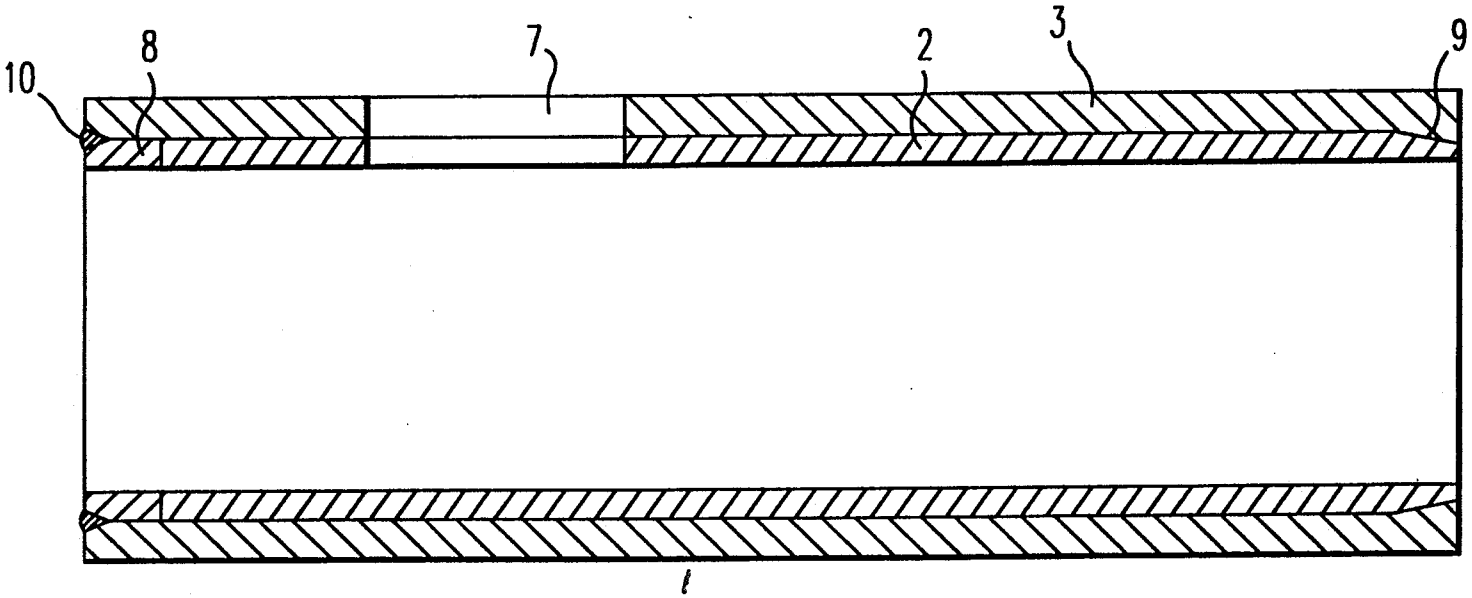
FIG. 4 is a sectional diagram showing another example of an injection sleeve for die casting according to the present invention.
Figure 1:
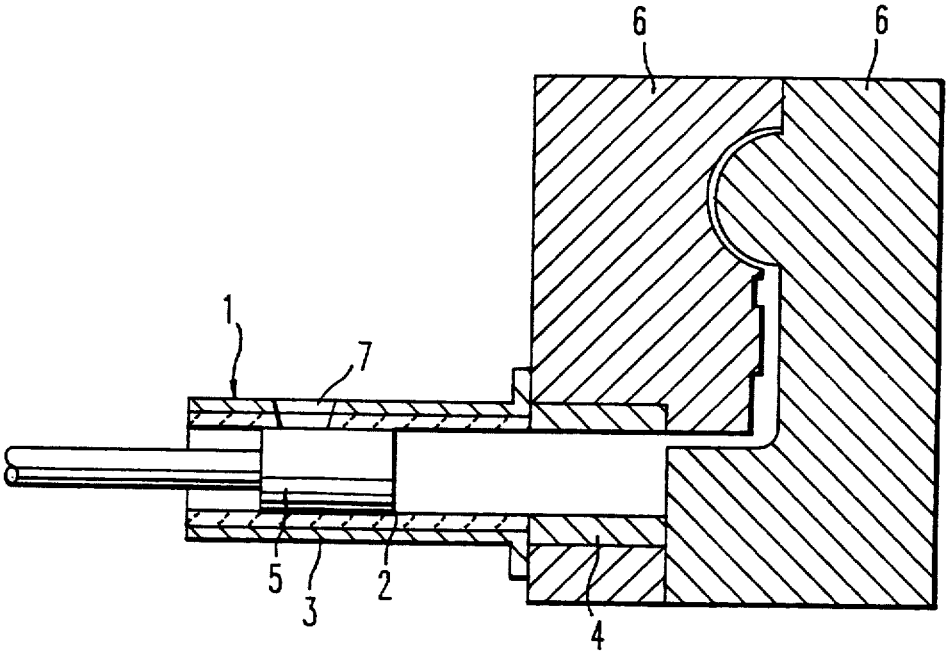
Figure 4:
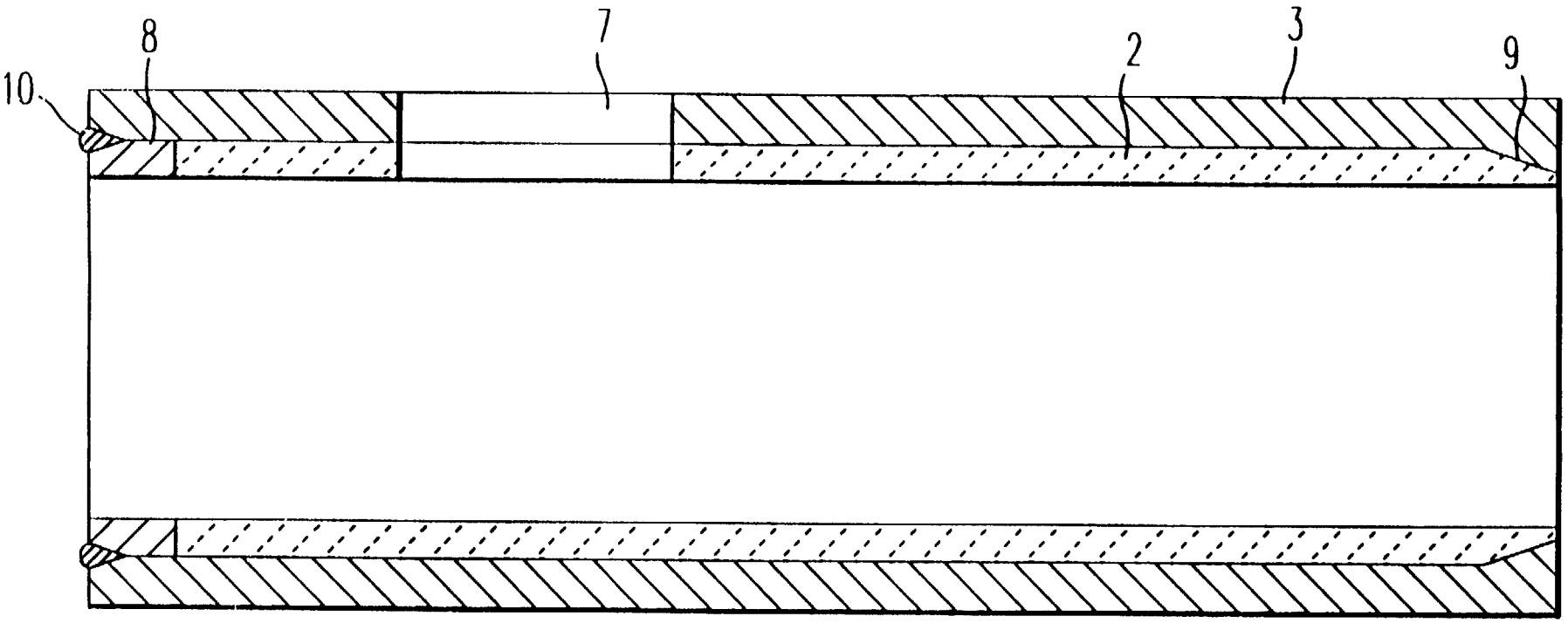

FIG. 4 is a sectional diagram showing an another example of the invented injection sleeve for die casting. In FIG. 4, reference numeral 8 designates a metal ring, 9, a tapered portion, and 10, a weld deposit. In this example, the invention is provided with a construction wherein an end portion of the cylindrical cermet sintered body does not come off the metal cylinder and does not cause a trouble such as the corner tipping, by the metal ring and the shrinkage-fitting with a metal cylinder having a tapered portion.

What is claimed is:

1. An injection sleeve for die casting comprising:

a cylindrical cermet sintered body comprising a hard ceramic phase whose major components are at least one selected from the group consisting of a complex boride of Ni and Mo, a complex boride of Ni and W and a complex boride of Ni, Mo and W and a metal matrix phase consisting of a solid solution whose major components are Ni and Mo, said cylindrical cermet sintered body containing the hard ceramic phase in an amount of not less than 50% by weight and not more than 90% by weight.

2. The injection sleeve for die casting according to claim 1, wherein the cylindrical cermet sintered body contains the hard ceramic phase in an amount of not less than 65% by weight and not more than 80% by weight.

3. The injection sleeve for die casting according to claim 1, further comprising:

a metal cylinder fitted to the outer periphery of the cylindrical cermet sintered body.

4. The injection sleeve for die casting according to claim 1, wherein the content of the hard ceramic phase of the cylindrical cermet sintered body at a first portion thereof in a region beneath a feeding port where molten metal to be cast contacts first is larger than the content of the hard ceramic phase at a second portion outer than the first portion.

5. The injection sleeve for die casting according to claim 1, wherein the content of the hard ceramic phase of the cylindrical cermet sintered body at a first portion thereof contacting a die cast mold is smaller than the content of the hard ceramic phase at a second portion other than the first portion.

6. The injection sleeve for die casting according to claim 3, further comprising:

a tapered portion provided at the outer periphery proximate to a first end portion of the cylindrical cermet sintered body of the injection sleeve contacting a die cast mold;

a tapered portion provided at the inner periphery of a first end portion of the metal cylinder corresponding to the first end portion of the cylindrical cermet sintered body; and a metal ring attached to a second end portion opposite to the first end portion of the metal cylinder preventing a second end portion opposite to the first end portion of the cylindrical cermet sintered body from coming off the metal cylinder.

7. A method of casting an aluminum or an aluminum alloy part by a die casting machine integrated with an injection sleeve comprising:

fitting a metal cylinder to the outer periphery of the injection sleeve, the injection sleeve comprising a cylindrical cermet sintered body comprising a hard ceramic phase whose major components are at least one selected from the group consisting of a complex boride of Ni and Mo, a complex boride of Ni and W and a complex boride of Ni, Mo and W and a metal matrix phase consisting of a solid solution whose major components are Ni and Mo, said cylindrical cermet sintered body containing the hard ceramic phase in an amount of not less than 50% by weight and not more than 90% by weight.

* * * * *

UNITED STATES PATENT AND TRADEMARK OFFICE

CERTIFICATE OF CORRECTION

PATENT NO. : 5,323,838

DATED : June 28, 1994

INVENTOR(S) : Hamashima, et al

It is certified that error appears in the above-indentified patent and that said Letters Patent is hereby corrected as shown below:

In the Drawing:

Delete Fig. 1, and substitute therefor the attached Fig. 1.

Signed and Sealed this

Twelfth Day of December, 1995

*Attest:*

*Attesting Officer*

Bruce Lehman

BRUCE LEHMAN

*Commissioner of Patents and Trademarks*

UNITED STATES PATENT AND TRADEMARK OFFICE
CERTIFICATE OF CORRECTION

PATENT NO. 5,323,838 Page 1 of 2

DATED : June 28, 1994

INVENTOR(S) : Kazuo Hamashima et al

It is certified that error appears in the above-identified patent and that said Letters Patent is hereby corrected as shown below:

Drawings:

Add the Drawing Sheet(s), consisting of Fig.4 as shown on the attached sheet

Signed and Sealed this

Third Day of September, 1996

*Attest:*

Bruce Lehman

BRUCE LEHMAN

*Attesting Officer*

*Commissioner of Patents and Trademarks*